US010125573B2

(12) United States Patent
Flores Perez et al.

(10) Patent No.: US 10,125,573 B2
(45) Date of Patent: Nov. 13, 2018

(54) ZONE SELECTION WITH SMART OBJECT SELECTIVELY OPERATING PREDETERMINED FRACTURING ACCESS VALVES

(71) Applicant: BAKER HUGHES, A GE COMPANY, LLC, Houston, TX (US)

(72) Inventors: Juan Carlos Flores Perez, The Woodlands, TX (US); James S. Sanchez, Tomball, TX (US); Yingqing Xu, Tomball, TX (US); Steve Rosenblatt, Houston, TX (US)

(73) Assignee: BAKER HUGHES, A GE COMPANY, LLC

( * ) Notice: Subject to any disclaimer, the term of this patent is extended or adjusted under 35 U.S.C. 154(b) by 410 days.

(21) Appl. No.: 14/875,269

(22) Filed: Oct. 5, 2015

(65) Prior Publication Data

US 2017/0096876 A1 Apr. 6, 2017

(51) Int. Cl.

| | |
|---|---|
| ***E21B 34/10*** | (2006.01) |
| ***E21B 34/14*** | (2006.01) |
| ***E21B 43/26*** | (2006.01) |
| ***E21B 33/14*** | (2006.01) |
| ***E21B 37/00*** | (2006.01) |
| ***E21B 43/20*** | (2006.01) |
| ***E21B 43/24*** | (2006.01) |
| *E21B 34/00* | (2006.01) |

(52) U.S. Cl.

CPC ..... *E21B 34/10* (2013.01); *E21B 33/14* (2013.01); *E21B 34/14* (2013.01); *E21B 37/00* (2013.01); *E21B 43/20* (2013.01); *E21B 43/24* (2013.01); *E21B 43/26* (2013.01); *E21B 2034/007* (2013.01)

(58) Field of Classification Search

CPC .... E21B 33/14; E21B 34/10; E21B 2034/007; E21B 37/00; E21B 43/20; E21B 43/24; E21B 43/26

See application file for complete search history.

(56) References Cited

U.S. PATENT DOCUMENTS

| | | | |
|---|---|---|---|
| 3,263,752 A | 8/1966 | Conrad | |
| 4,823,882 A | 4/1989 | Stokley et al. | |
| 7,322,417 B2 * | 1/2008 | Rytlewski | E21B 23/02 166/313 |

(Continued)

FOREIGN PATENT DOCUMENTS

WO 2012045165 A1 4/2012

*Primary Examiner* — Matthew R Buck
(74) *Attorney, Agent, or Firm* — Shawn Hunter

(57) ABSTRACT

An intelligent dart or ball or other shape is dropped or pumped into a borehole that has multiple valves for access to the formation through which fractures are initiated. The intelligent object engages with the valves as it passes with retractable engagement dogs that are outwardly biased but not to the degree needed to find support unless the valve in question is the one that needs to be operated. In that event the dogs become supported and pressure is applied to the object to shift the valve to the open position. The object can be released at a later time remotely or can be milled out. Subsequent objects can be landed in the same sleeve after the initial object is released to close it or to close the open port by moving a second sleeve against a first sleeve. Fracturing in any order is envisioned.

22 Claims, 4 Drawing Sheets

(56) References Cited

U.S. PATENT DOCUMENTS

| | | | | |
|---|---|---|---|---|
| 7,325,617 | B2 | 2/2008 | Murray | |
| 7,377,321 | B2 | 5/2008 | Rytlewski | |
| 7,552,779 | B2 | 6/2009 | Murray | |
| 8,157,090 | B2 | 4/2012 | Ingvardsen et al. | |
| 8,261,761 | B2 | 9/2012 | Gerrard et al. | |
| 8,291,988 | B2 | 10/2012 | King | |
| 8,356,670 | B2 | 1/2013 | Telfer | |
| 8,397,823 | B2 | 3/2013 | Xu | |
| 8,479,823 | B2 | 7/2013 | Mireles | |
| 8,505,632 | B2 * | 8/2013 | Guerrero | E21B 33/12 166/318 |
| 8,505,639 | B2 * | 8/2013 | Robison | E21B 23/04 166/194 |
| 8,616,285 | B2 | 12/2013 | Tinker et al. | |
| 8,646,531 | B2 | 2/2014 | King et al. | |
| 8,668,013 | B2 | 3/2014 | O'Connell et al. | |
| 8,701,776 | B2 | 4/2014 | Smith et al. | |
| 8,770,299 | B2 | 7/2014 | King | |
| 8,789,600 | B2 | 7/2014 | O'Connell et al. | |
| 8,863,853 | B1 | 10/2014 | Harris et al. | |
| 9,004,179 | B2 * | 4/2015 | Chauffe | E21B 34/06 166/250.04 |
| 9,004,180 | B2 | 4/2015 | Jackson | |
| 9,238,953 | B2 * | 1/2016 | Fleming | E21B 23/006 |
| 9,394,752 | B2 * | 7/2016 | Fleming | E21B 34/14 |
| 9,523,241 | B2 * | 12/2016 | Mageren | E21B 10/325 |
| 2011/0056692 | A1 * | 3/2011 | Lopez de Cardenas | E21B 34/06 166/305.1 |
| 2011/0284240 | A1 * | 11/2011 | Chen | E21B 23/00 166/373 |
| 2012/0085548 | A1 | 4/2012 | Fleckenstein et al. | |
| 2013/0081827 | A1 * | 4/2013 | Etzel | E21B 34/14 166/386 |
| 2013/0118732 | A1 | 5/2013 | Chauffe et al. | |
| 2013/0206402 | A1 * | 8/2013 | Coon | E21B 23/08 166/255.1 |
| 2014/0076542 | A1 * | 3/2014 | Whitsitt | E21B 34/14 166/250.1 |
| 2015/0075639 | A1 | 3/2015 | Xu et al. | |
| 2016/0258259 | A1 * | 9/2016 | Walton | E21B 34/14 |

* cited by examiner

ZONE SELECTION WITH SMART OBJECT SELECTIVELY OPERATING PREDETERMINED FRACTURING ACCESS VALVES

FIELD OF THE INVENTION

The field of the invention is hydraulic fracturing and more particularly smart object that can be preconfigured to operate a predetermined valve in an array of valves to fracture in any desired order.

BACKGROUND OF THE INVENTION

Fracturing can be accomplished using a series of valves that each have ball seats. The ball seats get progressively larger going uphole and progressively larger balls are launched or dropped to sequentially open the fracturing valves in a bottom up direction. As one zone is fractured the next ball isolates the already fractured zone and opens the next valve going in an uphole direction. The problem with this system is there is a limit to how many balls of different sizes can be accommodated in a borehole of a given size. Another problem is that the balls have such small size difference to accommodate as many zones as possible that surface personnel can inadvertently grab the wrong ball. Organizers for such ball arrays are shown in U.S. Pat. No. 8,157,090. Despite the use of organizers to keep track the wrong ball can still be inadvertently picked.

One offered solution to the progressively larger ball seats in a bottom up fracturing operation has been offered in U.S. Pat. No. 7,322,417. Here the same ball is used and all but the initial ball seat are retracted. Once the first ball lands and opens a fracturing valve, it also extends the next ball seat up to accept the same size ball. Here the offered advantage is that all the balls are the same size. The limitations are that the actuation order is still fixed from bottom up and the mechanism that connects the shifting of one ball seat to the extension of a ball seat above can be quite complex and expensive to build or operate.

Also relevant are U.S. Pat. No. 7,552,779 and U.S. Pat. No. 7,325,617; U.S. Pat. No. 4,823,882; U.S. Pat. No. 7,377,321; U.S. Pat. No. 8,356,670; U.S. Pat. No. 8,701,776; U.S. Pat. No. 9,004,180; U.S. Pat. No. 9,004,179; U.S. Pat. No. 8,616,285; U.S. Pat. No. 8,863,853; U.S. Pat. No. 8,479,823; U.S. Pat. No. 8,668,013; U.S. Pat. No. 8,789,600; U.S. Pat. No. 8,261,761; U.S. Pat. No. 8,291,988; U.S. Pat. No. 8,397,823; U.S. Pat. No. 8,646,531 and U.S. Pat. No. 8,770,299).

The present invention seeks to optimize a fracturing operation by using intelligent objects such as balls or darts that keep track of how many valve assemblies have been passed by the object so that the mechanism of the object can be reconfigured at the desired valve for latching and ultimately shifting the valve with applied pressure in the borehole. These and other aspects of the present invention will be more readily apparent to those skilled in the art from a review of the detailed description of the preferred embodiment and the associated drawings while recognizing that the full scope of the invention can be determined from the appended claims.

SUMMARY OF THE INVENTION

An intelligent dart or ball or other shape is dropped or pumped into a borehole that has multiple valves for access to the formation through which fractures are initiated. The intelligent object engages with the valves as it passes with retractable engagement dogs that are outwardly biased but not to the degree needed to find support unless the valve in question is the one that needs to be operated. In that event the dogs become supported and pressure is applied to the object to shift the valve to the open position. The object can be released at a later time remotely or can be collected or "fished" or can be milled out. Subsequent objects can be landed in the same sleeve after the initial object is released to close it or to close the open port by moving a second sleeve against a first sleeve. Fracturing in any order is envisioned.

DETAILED DESCRIPTION OF THE PREFERRED EMBODIMENT

Figure 1:
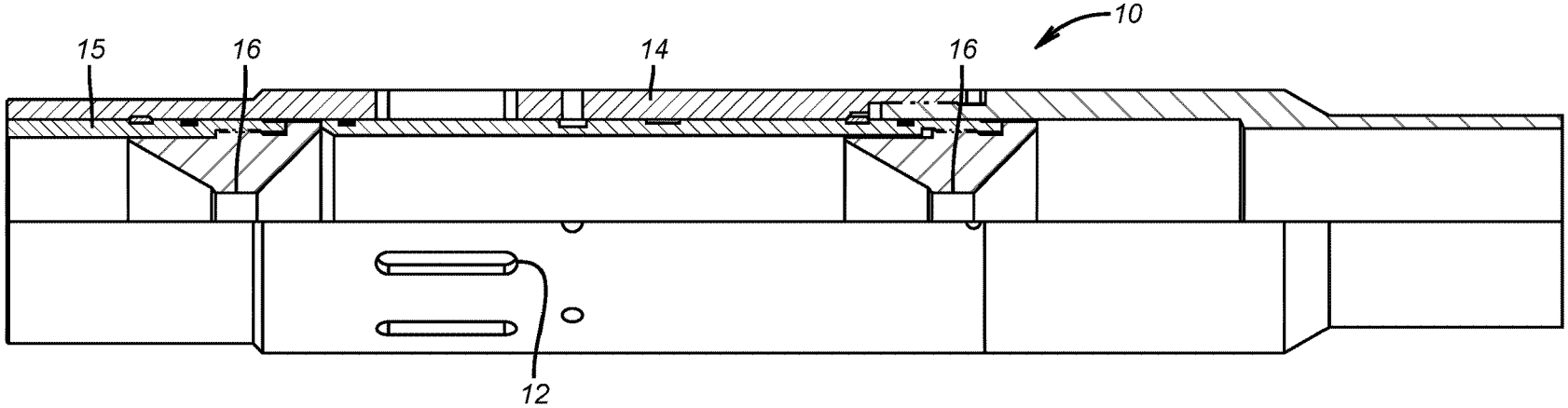
FIG. 1 is a section view of a sleeve that can be engaged by the intelligent object.
Figure 2:
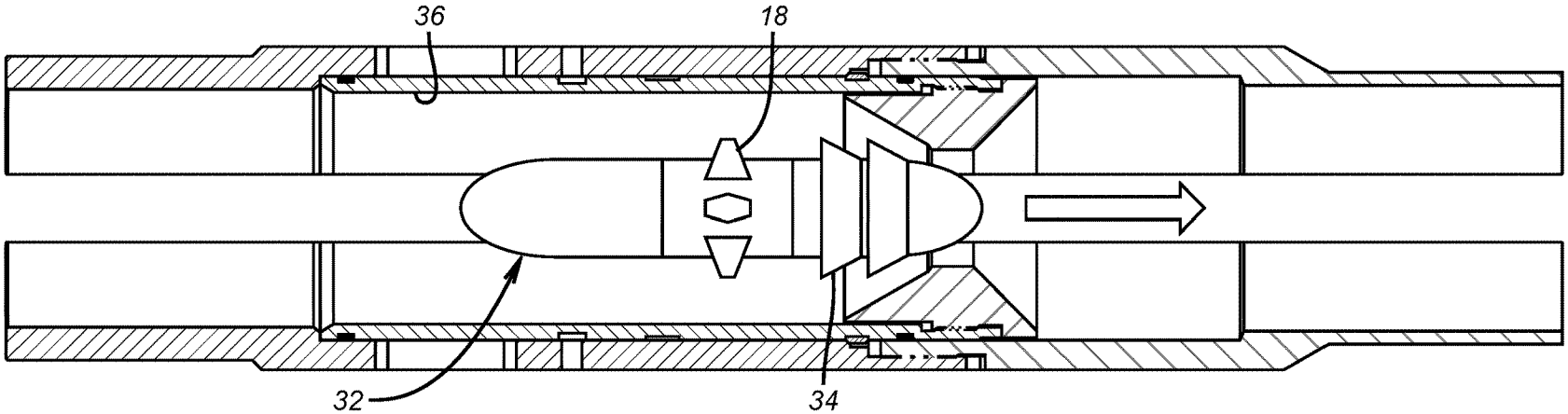
FIG. 2 is the view of FIG. 1 with the object about to land on the sleeve.
Figure 4:
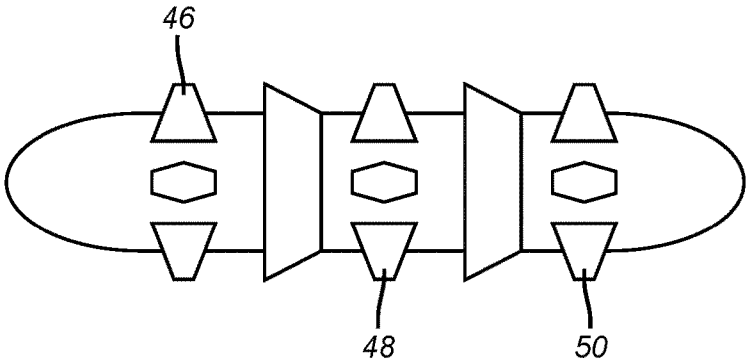
FIG. 4 is an alternative embodiment of the object.
Figure 6:
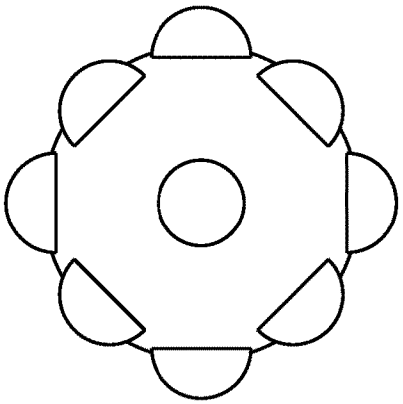
FIG. 6 is another alternative embodiment of the invention.
Figure 3:
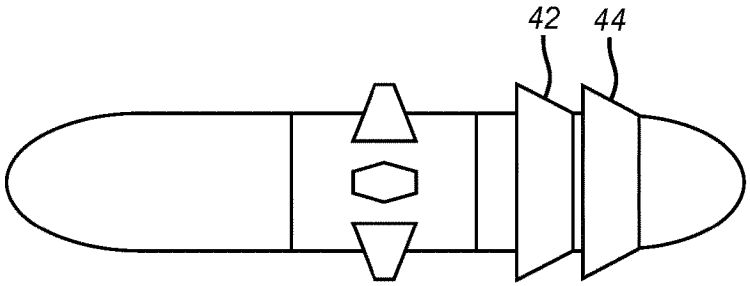
FIG. 3 is one embodiment of the object.
Figure 5:
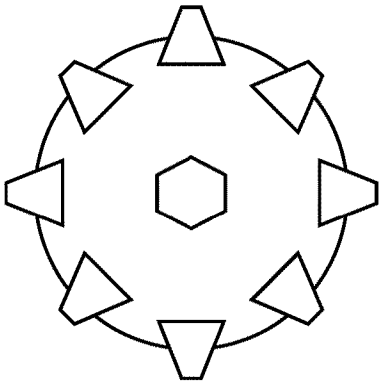
FIG. 5 is an end view of the object in FIG. 4
Figure 7:
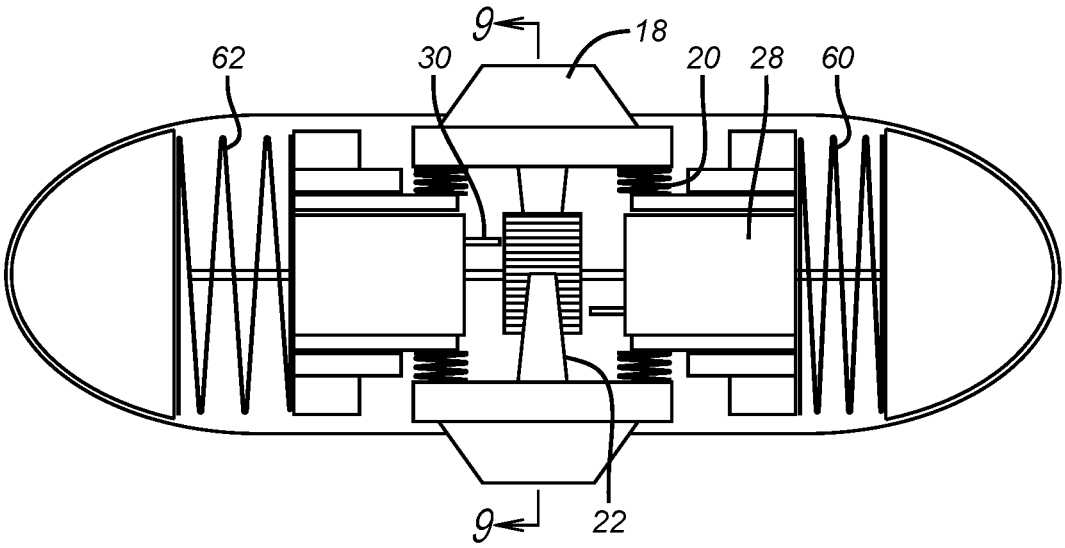
FIG. 7 is a detailed section view of one embodiment of the object.
Figure 8:
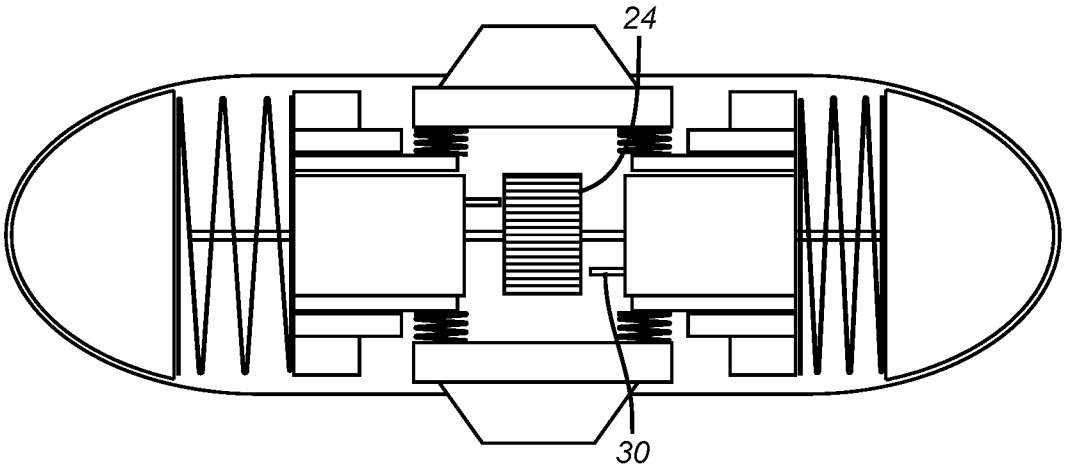
FIG. 8 is a rotated section view from FIG. 7.
Figure 9:
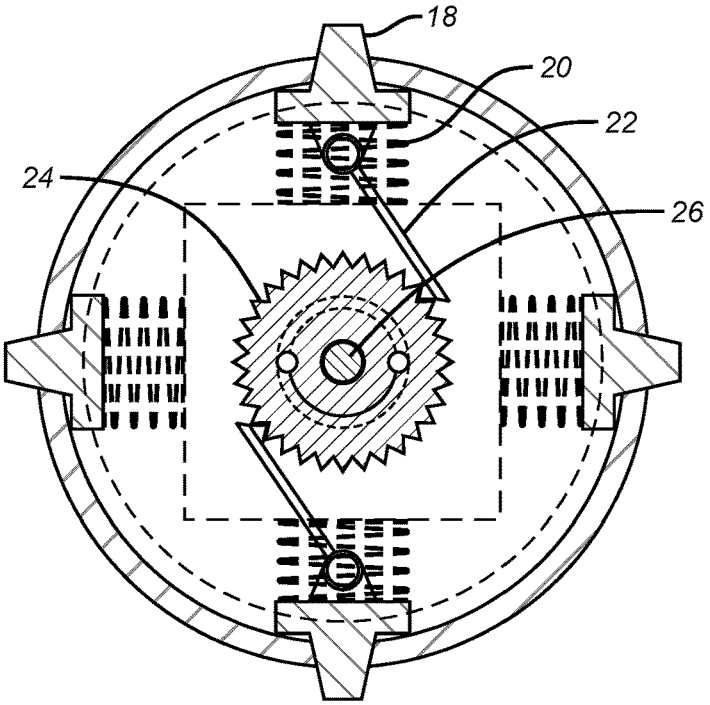
FIG. 9 is a section view in the direction of arrow 9 in FIG. 7
Figure 10:
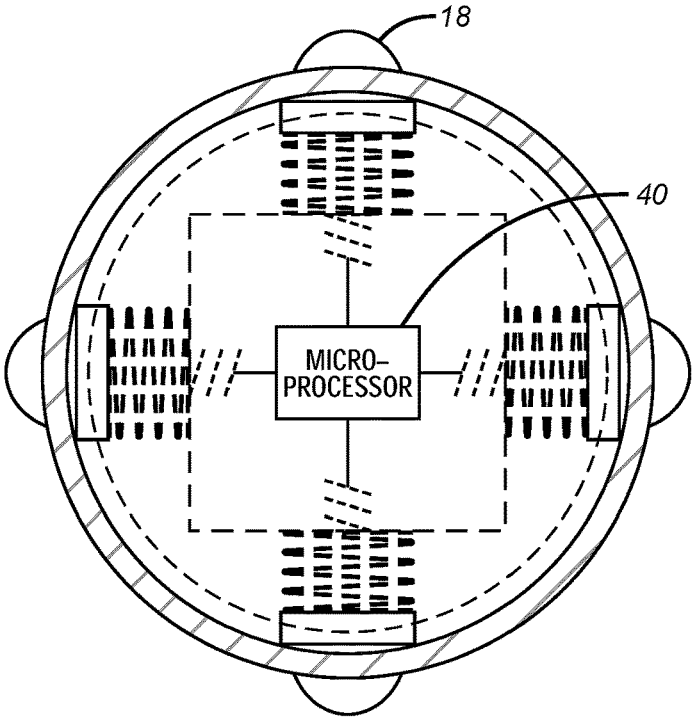
FIG. 10 is an alternative object design whose locking feature is electronic.

FIG. 1 shows one of several variations for the fracturing sleeve valve 10 that can open the ports 12 in housing 14. A seat 16 engages dogs 18 that are biased out radially by springs 20. Dogs 18 are connected by a schematically illustrated link 22 best seen in FIG. 9. Link 22 can be connected to a rotating circular ratchet 24 that turns in a single direction each time the dogs 18 get pushed against springs 20. Ratchet 24 rotates on shaft 26 and the amount of rotation is sensed by the processor 28. The processor 28 is programmed to sense a predetermined amount of rotation at which time it can extend a schematically illustrated lock pin or pins 30 into the ratchet 24 so that the dogs cannot retract. Once the dogs 18 land on the next seat 16 they will support the object 32 onto the seat 16 so that pressure against seal assembly 34 moves sleeve 36 to open ports 12. The locking of the dogs 18 in the extended position can occur after a predetermined number of cycles of retraction and extension measured by a processor 40 that can then move a support under the dogs 18 to prevent their retraction as illustrated in FIG. 10. This form of locking can be triggered electromagnetically, electromechanically or with a pressure switch to name a few examples. The seal assembly 34 can be adjacent packer cups 42 and 44 or they can be spaced further apart in an alternating pattern with rows of dogs 46, 48 and 50 as shown in FIG. 4.

The preferred order of operation of sleeves 36 is bottom up so that each landed object that shifts a given sleeve can isolate zones below that have already been fractured. However other orders of sleeve operation are possible. For example, if the sleeves 36 had two landing locations that straddled the ports 12 than the initial object could shift sleeve 36 a first time and another object 32 can land on another seat that would be above the now open ports 12 so that pressure could again be built up to move the same sleeve a second time and blank off ports 12. In this case the sleeve 36 would be configured with wall ports that align with ports 12 in the open position and a blank section that comes into alignment with the ports 12 for the closed position. Another way to be able to open the ports 12 and then close them would be to use two adjacent sleeves 36 and 15. The first sleeve 36 can be as shown in FIG. 1 and the second sleeve 15 can be identical to it and simply push the first sleeve 36 enough to place the second sleeve that is adjacent in line with the ports 12 to close them.

Another feature can be a remote release for the object 32 using the processor 28 or 40 so that after shifting a sleeve such as 36 the object 32 is released to go the hole bottom or a catcher that is not shown. Alternatively the various landed objects 32 on the various sleeves 36 can be simply milled out or flowed out of the well when production starts after a bottom up sequence for fracturing.

The objects 32 can all be identical and just be programmed to engage specific seats in specific sleeves in a predetermined order. They can have external indication of how many cycles they will undertake before locking the dogs so that the next sleeve is landed on. The ratchet mechanism can be linear or circular. Any locking feature that can be actuated after a predetermined moving of the dogs in and out can be employed. In this manner the landing location for each object is predetermined. The exterior shape of the object can vary from spherical to an elongated shape. The internal components such as the processor 28 can be cushioned with springs such as 60 or 62. Those skilled in the art will appreciate that the present invention involves programmable objects to land on predetermined sleeves to facilitate bottom up fracturing. With some modification to the sleeve design or by using sleeve pairs the ports to the formation that are opened can also thereafter be closed. This feature can allow re-fracturing only specific zones by closing the remaining sleeves. The objects can be remotely triggered to release from a shifted sleeve. Optionally the sleeves can communicate data on their movement or lack thereof in real time to a surface location using a variety of signaling techniques to the surface such as acoustic, mud pulses, RFID or other types of known telemetry techniques. Of course a pressure buildup at the surface is another signal that an object has landed on a sleeve.

Another alternative can be electronic, or proximity or over the air or fluid signaling from each sleeve as the object goes by it. After the predetermined number of signals are detected then the dogs can be extended to land on the very next sleeve for operating the sleeve with applied pressure. In that manner the dogs do not need to physically engage a profile on each sleeve as that sleeve is passed. Release of the objects after landing can be accomplished with pressure application and removal cycles that eventually allow the support for the dogs to be undermined so that pressure in the borehole can displace the object from the supported location.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc. Another operation can be production from said zone or injection into said zone.

The above description is illustrative of the preferred embodiment and many modifications may be made by those skilled in the art without departing from the invention whose scope is to be determined from the literal and equivalent scope of the claims below:

We claim:

1. An apparatus for sequentially operating a plurality of tubular valves each having at least one seat thereon for subterranean access through ports at spaced locations on a tubular string having a passage therethrough and extending from a top of a well comprising:

a plurality of bodies having at least one selectively extendible member so that each body engages a predetermined said seat for support on a predetermined one of said valves on the basis of how many of said valves have been passed by said body for sequential operation of said valves whereupon passing of one or more of said seats other than said predetermined seat, without obtaining support for a respective body, operates a lockable counter device, said counter device selectively locked to prevent said extendible member from retracting into said respective body and therefor finding support for said respective body on said predetermined seat;

said respective body moving a sleeve of said valve via said predetermined seat a first distance to open a respective port and further moving said sleeve in the same direction to close said port or a first of said plurality of bodies moving a first sleeve to open a respective port and a second of said plurality of bodies moving a second sleeve toward said first sleeve to close said respective port.

2. The apparatus of claim 1, wherein:

said extendible member engages each of said valves that said respective body passes.

3. The apparatus of claim 1, wherein:

said extendible member of said predetermined body engages for support a said predetermined seat only after passing a predetermined number of said seats.

4. The apparatus of claim 2, wherein:

said extendible member is biased away from an axis of said body.

5. The apparatus of claim 4, wherein:

said lockable counter device is mechanical.

6. The apparatus of claim 4, wherein:

said lockable counter device is electrical.

7. The apparatus of claim 5, wherein:

said extendible member comprises a plurality of circumferentially spaced spring loaded dogs wherein at least some of said dogs are linked to a ratchet assembly moved by each cycle of radial movement of said dogs relative to a longitudinal axis of said body of said dogs on contact with a said seat on each valve being passed by said body.

8. The apparatus of claim 7, wherein:

said ratchet assembly moves linearly or rotationally.

9. The apparatus of claim 7, wherein:

at least some of said dogs of are linked to a cycle counter of opposed radial movements of said dogs for electrically or hydraulically or magnetically holding said dogs extended for support on a said predetermined seat of said respective valve next reached by said body.

10. The apparatus of claim 1, wherein:

said body further comprises at least one seal for delivery of a force to said predetermined valve with pressure applied in said passage against said body to shift said predetermined valve to an open position.

11. The apparatus of claim 10, wherein:

each of said valves has two spaced said seats to accept two of said bodies for sequentially opening and then closing said valves.

12. The apparatus of claim 10, wherein:

at least one of said valves comprises adjacent sleeves each having an associated seat such that a said body finding support on a first of said adjacent sleeves opens access through to a formation and another said a body supported on a second of said adjacent sleeves closes formation access.

13. The apparatuses of claim 10, wherein:

said extendible member comprises a plurality of circumferentially spaced spring loaded dogs;

said at least one seal comprises a plurality of spaced seals located on one side of said dogs or in a longitudinally alternating pattern with said dogs.

14. The apparatus of claim 8, wherein:

said ratchet assembly movement is sensed by a processor which extends a locking member into said ratchet to lock said dogs extended from said body.

15. The apparatus of claim 1, wherein:

said plurality of bodies open said valves in a direction from closest to a well bottom to closest to a surface location.

16. The apparatus of claim 1, wherein:

more than one of said bodies find support on a said valve for opening and closing said valve.

17. The apparatus of claim 10, wherein:

said valve is opened with pressure in said tubular string applied against said seal.

18. The apparatus of claim 3, wherein:

said extendible member extends in response to one or more signals from said valves that are acoustic, mud pulses or RFID.

19. The apparatus of claim 1, wherein:

said body moves to a well bottom or a catcher.

20. The apparatus of claim 4, wherein:

said lockable counter device is hydraulic.

21. A wellbore treatment method, comprising:

delivering a plurality of bodies having at least one selectively extendible member to engage at least one predetermined seat on one of a plurality of valves that provide selective communication with a surrounding zone when at least one body of said plurality of bodies is supported on said at least one predetermined seat, said support occurring on the basis of how many of said valves have been passed by said body for sequential operation of said valves with different said bodies whereupon passing of each seat other than said predetermined seat operates a lockable counter device, said counter device selectively locked to prevent said extendible member from retracting into said body and therefor finding support on said predetermined seat;

opening said valve by moving said predetermined seat with said body of said plurality of bodies for access to said surrounding zone;

performing a treatment operation to said surrounding zone or producing said zone or injecting into said zone;

selectively closing at least one of said valves with continued movement in the same direction of said at least one predetermined seat after said opening and said performing.

22. The method of claim 21, wherein:

said treatment operation comprises making said treatment one or more of hydraulic fracturing, stimulation, tracer injection, cleaning, acidizing, steam injection, water flooding or cementing.

* * * * *